United States Patent [19]

Nakagawa et al.

[11] Patent Number: 4,789,442

[45] Date of Patent: Dec. 6, 1988

[54] METHOD FOR PRODUCING ADIPONITRILE

[75] Inventors: Koji Nakagawa, Kurashiki; Yukito Nagamori, Nobeoka, both of Japan

[73] Assignee: Asahi Kasei Kogyo Kabushiki Kaisha, Osaka, Japan

[21] Appl. No.: 106,353

[22] Filed: Oct. 9, 1987

[30] Foreign Application Priority Data

Oct. 30, 1986 [JP] Japan ..... 61-256883

[51] Int. Cl.[4] ..... C25G 3/00

[52] U.S. Cl. ..... 204/73 A; 210/634; 210/638

[58] Field of Search ..... 204/73 A, 129; 210/634, 210/638

[56] References Cited

U.S. PATENT DOCUMENTS 3,689,382 9/1972 Fox et al. ..... 204/73 A
3,897,318 7/1975 Heckle et al. ..... 204/73 R
3,898,140 8/1975 Lester, Jr. et al. ..... 204/73 A
4,207,151 6/1980 Franke et al. ..... 204/73 A

OTHER PUBLICATIONS

Sigeru Torii, "Recent Advances in Electroorganic Synthesis", Elsevier, 1987.

*Primary Examiner*—R. L. Andrews
*Attorney, Agent, or Firm*—Birch, Stewart, Kolasch & Birch

[57] ABSTRACT

A method for producing adiponitrile through the electrohydrodimerization of acrylonitrile by electrolyzing an emulsion comprised of an aqueous phase and an organic phase in at least one undivided cell having a cathode of lead or a lead alloy, in which an ethyltributylammonium salt as a quaternary ammonium salt is included in the aqueous phase in a concentration of from 0.02 to 0.08 mol/liter. The method of the present invention is remarkably improved with respect to the prevention of the corrosion of the cathode.

6 Claims, 2 Drawing Sheets

METHOD FOR PRODUCING ADIPONITRILE

BACKGROUND OF THE INVENTION

1. Field of The Invention

The present invention relates to a method for producing adiponitrile. More particularly, the present invention is concerned with an improved method for producing adiponitrile by the electrohydrodimerization of acrylonitrile in an undivided cell. The electrolyte used is composed of an acrylonitrile-containing emulsion comprised of an aqueous phase and an organic phase, wherein the aqueous phase contains a specific amount of an ethyltributylammonium salt. The method of the present invention is improved with respect to the prevention of the corrosion of the cathode metal or metal alloy employed in the cell.

2. Discussion of Related Art

Production of adiponitrile by electrohydrodimerization of acrylonitrile is known in the art. The reaction therefor is believed to proceed as follows.

Cathodic reaction: $2CH_2{=}CHCN + 2H^+ + 2e \longrightarrow NC(CH_2)_4CN$

Anodic reaction: $H_2O - 2e \longrightarrow 2H^+ + \frac{1}{2}O_2\uparrow$

Overall Reaction $2CH_2{=}CHCN + H_2O \longrightarrow NC(CH_2)_4CN + \frac{1}{2}O_2\uparrow$ Besides the above predominant reactions, the following side reactions occur.

$$CH_2{=}CHCN + 2H^+ + 2e \rightarrow CH_3CH_2CN$$

$$NC(CH_2)_4CN + CH_2{=}CHCN \longrightarrow NC(CH_2)_2\underset{\underset{CN}{|}}{CH}(CH_2)_3CN, \text{ etc.}$$

Adiponitrile has been produced on a commercial scale by electrohydrodimerization of acrylonitrile in which a cell divided into two compartments by a membrane is employed. The membrane is employed in order to prevent the acrylonitrile from undergoing oxidation at the anode, which would lead to a decrease in the yield of adiponitrile produced. However, the electrohydrodimerization of acrylonitrile which employs a membrane has drawbacks in that the power consumption due to the membrane resistance as well as the cost of the membrane are high.

Accordingly, various methods of conducting electrohydrodimerization of acrylonitrile in an undivided cell, in which no membrane is used, have been proposed in the art.

For example, it has been proposed to conduct electrohydrodimerization of an olefinic compound such as acrylonitrile or the like by a method comprising electrolyzing an aqueous solution having dissolved therein at least about 0.1% by weight of the olefinic compound, quaternary ammonium ions in a concentration from about $10^{-5}$ to about 0.5 gram mol per liter and at least about 0.1% by weight of a phosphate, borate or carbonate of an alkali metal in an undivided cell having a cadmium cathode and a carbon steel anode (see the Examples of U.S. Pat. No. 3,897,318). This method is advantageous in that the cadmium cathode is resistant to corrosion, but is disadvantageous in that cadmium used as the cathode has a high toxicity and therefore, a special treatment of waste water and other costly, time-consuming operations are necessary.

In conducting the electrohydrodimerization of acrylonitrile in an undivided cell, it is preferred that the cathode of the cell be comprised of a metal exhibiting a high hydrogen overvoltage. It is known that besides the above-mentioned cadmium, mercury and lead exhibit a high hydrogen overvoltage. Lead, which is less toxic as compared with cadmium and mercury, is used as a cathode material in an undivided cell for the electrohydrodimerization of acrylonitrile. For example, U.S. Pat. No. 3,898,140 and U.S. Pat. No. 3,689,382 disclose the electrohydrodimerization of acrylonitrile in an undivided cell in which lead has been used as the cathode material and a combination of an alkali metal salt and an ethyltributylammonium salt has been used as the electrolysis supporting salt. In these U.S. patents, the purposes of using the ethyltributylammonium salt are solely to increase the conductivity of the electrolyte and hence the yield of adiponitrile, and accordingly, the ethyltributylammonium salt concentration of the aqueous phase is generally not greater than 0.01 mol/liter. However, the methods as disclosed in these U.S. patents have a drawback in that the corrosion of the cathode is rapid. Further, the method of U.S. Pat. No. 3,898,140 is accompanied by a drawback in that the evolution of hydrogen gas is still intense, which evolution is undesirable from the viewpoint of adiponitrile yield.

To overcome the problem of the evolution of hydrogen gas at the cathode in a process for producing adiponitrile which comprises electrolyzing an emulsion containing acrylonitrile and, as electrolysis supporting salt, a combination of an alkali metal salt and a quaternary ammonium salt in an undivided cell having a lead alloy cathode, it has been proposed in Japanese Patent Application Publication Specification No. 61-21316/1986 to continuously or intermittently take the electrolyte out of the electrolytic cell and recycle the same through a column packed with a chelate resin to the electrolytic cell. It is noted that in the Examples of this publication, use is made of a single undivided cell, not connected to any other cells, which is provided with lead alloy cathode having a rectangular current-passing surface of only 90 cm in length and an anode also having a rectangular current-passing surface of the same size.

In the production of adiponitrile on a commercial scale, it is necessary to pass a large amount of electric current between the anode and the cathode. Accordingly, the anode and the cathode should have a large current-passing surface. The area of a generally employed rectangular current-passing surface of the anode or cathode can be increased either by increasing the length of the surface, along which the emulsion flows, or increasing the width of the surface, which is perpendicular to the direction of flow of the emulsion. Generally, increasing the length of the current-passing surface is preferred to increasing the width of the surface from the viewpoint of the cost of pumps, piping and other facilities for circulating the emulsion. with the increase of the length of the current-passing surface, the amount of oxygen gas evolved is incresed at the terminus of the current-passing surface, which terminus generally corresponds to the outlet of the cell and so is hereinafter referred to as the outlet of the cell. In an example of Japanese Patent Application Publication Specification No. 61-21316/1986, the use of an ethytributylammonium salt in an amount of 0.009 mol/l is indicated. However, the electrolysis of this example is accoompanied by rapid corrosion of the cathode, when the evolution of oxygen is intense at the outlet of the cell. In this publication, a tetraethylammonium salt is employed at a relatively high concentration. However, as demonstrated in a comparative example given later, the use of the tetraethylammonium salt even at a relatively high concentration is not effective for retarding the corrosion of the cathode where the evolution of oxygen is intense at the outlet of the cell. Therefore, the method as disclosed in this publication is not advantageous from the viewpoint of cathode corrosion.

As is apparent from the foregoing, the hitherto known methods have drawbacks, and hence there is still a strong demand in the art for an effective method of producing adiponitrile by electrohydrodimerization of acrylonitrile in an undivided cell provided with a lead or lead alloy cathode, which method is free from or remarkably improved in respect of the problems such as corrosion of the cathode.

SUMMARY OF THE INVENTION

With a view toward obviating the drawbacks of the conventional methods, the present inventors have conducted extensive and intensive studies. As a result, the present inventors have unexpectedly found that there is a definite relationship between the oxygen evolved at the anode and the corrosion of the cathode, and that specifically, the corrosion of the cathode is extremely rapid when the amount of oxygen evolved is large. Moreover, the present inventors have unexpectedly found that the corrosion of the cathode is dependent on the concentration of ethyltributylammonium salt, which is generally employed as an electrolysis supporting salt in order to increase the conductivity of the electrolyte, in the aqueous phase of the electrolyte as shown in FIG. 1. The present inventors have further unexpectedly found that when the ethyltributylammonium salt concentration is in a specific range, the corrosion rate of the cathode can be advantageously retarded while ensuring desirably high yield of adiponitrile, even in the case where the evolution of oxygen gas is intense at the outlet of the cell. The present invention is based on these novel findings. This specific ethyltributylammonium salt concentration range is much higher than that required for increasing the conductivity of the electrolyte as used in the prior publications such as U.S. Pat. No. 3,898,140 in which an ethyltributylammonium salt is employed in an amount of 0.008 mol/liter in Example VI, U.S. Pat. No. 3,689,382 in which an ethytributylammonium salt is employed in an amount of 0.001 to 0.004 mol/liter, and Japanese Patent Application Publication Specification No. 61-21316/1986 in which an ethyltributylammonium salt is employed in an amount of 0.009 mol/liter.

Accordingly, it is an object of the present invention to provide a novel, effective method for producing adiponitrile by electrohydrodimerization of acrylonitrile in an undivided cell provided with a lead or lead alloy cathode, which method is remarkably improved in respect of the problem, such as corrosion of the cathode.

The foregoing and other objects, features and advantages of the present invention will be apparent from the following detailed description and appended claims taken in connection with the accompanying drawings.

DETAILED DESCRIPTION OF THE INVENTION

Figure 1:
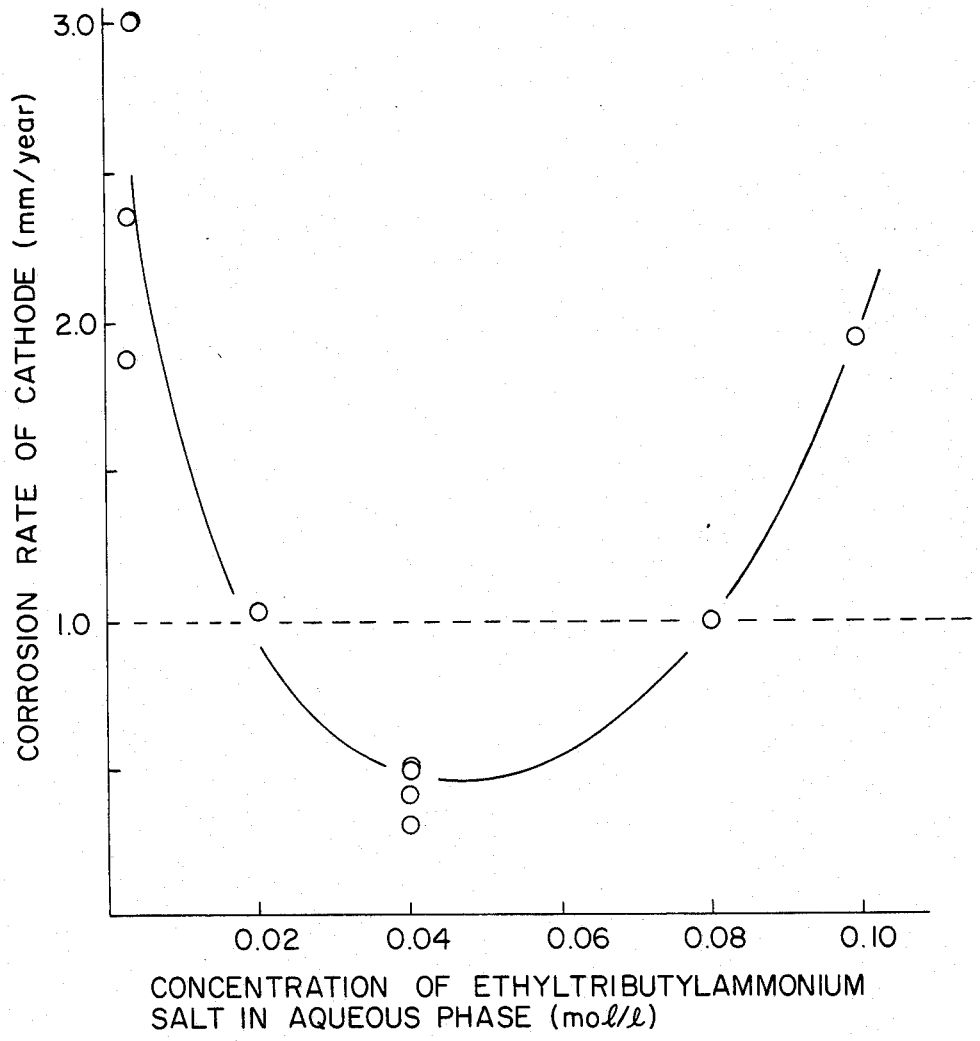
FIG. 1 is a graph showing the relationship between the corrosion rate of the cathode in the undivided cell and the concentration of ethyltributylammonium salt in the aqueous phase of the emulsion in a method for producing adiponitrile by electrohydrodimerization of acrylonitrile.

According to the present invention, there is provided an improvement in a method for producing adiponitrile which comprises electrolyzing an emulsion of an aqueous phase and an organic phase, said emulsion containing acrylonitrile and a combination of an alkali metal salt and a quaternary ammonium salt as an electrolysis supporting salt, in at least one undivided cell having a cathode of lead or a lead alloy and an anode and having an inlet and an outlet, while feeding said emulsion into said cell at its inlet and circulating said emulsion through said cell from said inlet to said outlet, thereby forming adiponitrile while evolving oxygen gas, which improvement comprises including in said aqueous phase an ethyltributylammonium salt as the quaternary ammonium salt in a concentration of from 0.02 to 0.08 mol/liter, and wherein said electrolysis is conducted in said undivided cell with evolution of an increased volume of oxygen gas, thereby enabling adiponitrile to be produced in an increased quantity.

In the present invention, an emulsion is electrolyzed in at least one undivided cell. The emulsion to be employed in the present invention consists of an organic phase and an aqueous phase. The proportion of the amount of the organic phase to that of the aqueous phase is not critical. However, the organic phase content is generally in the range of from about 6 to 30% by weight, preferably from 10 to 30% by weight, more preferably from 15 to 30% by weight based on the total amount of the emulsion, so that the separation and recovery of adiponitrile as a product can be facilitated and the composition of the electrolyte, especially the concentration of acrylonitrile, can be stably maintained despite fluctuation in operation conditions, thereby attaining a high adiponitrile yield.

In the method of the present invention, the organic phase generally comprises acrylonitrile, adiponitrile, a quaternary ammonium salt, water and by-products such as propionitrile and 1,3,5-tricyanohexane. On the other hand, the aqueous phase generally comprises water and, dissolved therein, a combination of an alkali metal salt and an ethyltributylammonium salt in the form of a quaternary ammonium salt, as the electrolysis supporting salt, acrylonitrile, adiponitrile and by-products such as propionitrile and 1,3,5-tricyanohexane. The concentrations of acrylonitrile, adiponitrile and by-products in the aqueous phase are in equilibrium with those in the organic phase.

The acrylonitrile concentration in the organic phase of the emulsion to be employed in the present invention is generally in the range of from 10 to 45% by weight, preferably from 15 to 35% by weight. When the acrylonitrile concentration is lower than 10% by weight, the undesirable evolution of hydrogen gas at the cathode tends to increase. On the other hand, when the acrylonitrile concentration is higher than 45% by weight, the formation of acrylonitrile polymers and other by-products unfavorably tends to increase.

In the present invention, an alkali metal salt and an ethyltributylammonium salt are employed as components of the electrolysis supporting salt. When an alkali metal salt is employed alone, the adiponitrile yield tends to decrease and the evolution of hydrogen gas tends to undesirably increase. On the other hand, when an ethyltributylammonium salt is employed alone, the cell voltage is undesirably high. Therefore, in the present invention, the combination of an alkali metal salt and an ethyltributylammonium salt in the form of a quaternary ammonium salt, as electrolysis supporting salt, is necessarily employed.

The type of the cation of the alkali metal salt to be employed in the present invention is not critical. Examples of the cation include cations of lithium, sodium, potassium, and rubidium. These may be employed alone or in mixture. Of these, sodium and potassium cations are preferred because they are generally less expensive than the others.

The type of the anion of the alkali metal salt to be employed in the present invention is also not critical. Likewise, the type of the anion of the ethyltributylammonium salt to be employed in the present invention is not critical. As such anions for the alkali metal salt and the ethyltributylammonium salt, there may be mentioned, for example, anions from inorganic acids such as phosphoric acid, sulfuric acid and boric acid. These may be employed alone or in combination. These anions are generally divalent in the aqueous phase to be employed in the present invention, which phase generally has a pH value of from about 5 to 10. It is generally preferred that a phosphate anion and an anion from inorganic acids, especially boric acid, be employed in combination.

The concentration of an alkali metal salt in the aqueous phase is not critical, as long as the salt is soluble in the aqueous phase. However, from the viewpoint of improving the conductivity of the emulsion, the alkali metal salt concentration is generally not lower than 0.1% by weight, preferably not lower than 1% by weight, based on the amount of the aqueous phase.

In the method of the present invention, it is critically important that an ethyltributylammonium salt as a quaternary ammonium salt is included in the aqueous phase in a concentration of from 0.02 to 0.08 mol/liter in the aqueous phase. This concentration is much higher than that conventionally employed for the purpose of improving the conductivity of the emulsion as an electrolyte. When the ethyltributylammonium salt concentration exceeds 0.08 mol/liter, a polymeric substance tends to form and adhere to the surface of the cathode, thereby causing the passage of the electric current to be disturbed, so that the rate of the corrosion of the cathode becomes higher than 1 mm/year. When the ethyltributylammonium salt concentration is lower than 0.02 mol/liter, retardation of the corrosion of the cathode is insufficient. In general, as long as the corrosion rate of a cathode is not greater than 1 mm/year, such a cathode can be effectively utilized in the production of adiponitrile on a commercial scale. In this connection, reference may be made to the manual entitled "Safety Engineering Manual" published by Corona Publishing Co., Ltd., Tokyo, Japan in which it is indicated that the acceptable limit for the corrosion rate is 1.25 mm/year. Also, reference may be made to the material entitled "Table of Material Anti-corrosion Properties for Chemical Equipment Facilities" published by Kagaku Kogyo-sha, Tokyo, Japan in which it is indicated that the acceptable limit for the corrosion rate is 1.0 mm/year. When the ethyltributylammonium salt concentration is in the range of from 0.02 to 0.08 mol/liter according to the process of the present invention,the corrosion rate of the cathode does not exceed about 1 mm/year. This is substantiated in FIG. 1.

In the present invention, an ethyltributylammonium salt is employed as a quaternary ammonium salt. According to the study by the present inventors, other quaternary ammonium salts also have the property of being capable of decreasing the corrosion rate of the cathode. However, for exerting the corrosion rate decreasing effect by the use of such salts, it is necessary to use the salts in a concentration as high as several times the concentration in the range used in the present invention. At such high concentration, the resistance of the electrolyte becomes undesirably high, thereby disadvantageously increasing the cell voltage which in turn increases the power consumption. On the other hand, with respect to a quaternary ammonium salt having a larger number of carbon atoms, its lipophilicity increases so that the recovery of such a salt from the organic phase becomes difficult, which would thereby cause a material loss. Further, it is noted that an ethyltributylammonium salt can be readily produced from diethyl sulfate and a tertiary amine.

In the present invention, the pH value of the emulsion as an electrolyte is generally in the range of from about 5 to 10, preferably from 6 to 10, more preferably from 7 to 10. When the pH value exceeds 10, the amount of by-products tends to increase.

It is requisite that the anode to be employed in the present invention have a low oxygen overvoltage. Examples of the anode suitably employable are pure iron and iron alloys such as mild steel, carbon steel, stainless steel, nickel steel, low-alloy steel and the like. The cathode to be employed in the present invention is comprised of lead or a lead alloy having generally a lead content of at least 90% by weight, preferably at least 95% by weight. The type of the non-lead component of the lead alloy for use as the cathode to be employed in the present invention is also not critical. Examples of suitable non-lead components of the lead alloy include at least one metal selected from the group consisting of Sb, Ag, Cu and Te. The lead alloy containing any one of these metals exhibits an improved mechanical strength and anti-corrosion properties. Further, examples of suitable non-lead components of the lead alloy include at least one metal selected from the group consisting of Na, Li, Ca and Ba. The lead alloy containing any one of these metals exhibits an improved hardness.

In the present invention, the emulsion is electrolyzed at a temperature at which deposition of the alkali metal salt does not occur. The temperature of the emulsion is generally in the range of from about 20° C. to 75° C., preferably from 30° C. to 70° C., more preferably from 45° C. to 65° C.

The emulsion is generally electrolyzed at a current density of from about 0.05 to 70 A, preferably from 1 to 50 A, more preferably from 5 to 40 A, per $dm^2$ of the surface of the cathode.

The distance between the anode and the cathode is generally in the range of from about 0.1 to 5 mm, preferably from 1 to 3 mm. The emulsion is generally passed at a velocity of from about 0.1 to 4 m/sec, preferably from 0.5 to 2.5 m/sec, through the space between the anode and the cathode.

After initiation of the electrolysis, a portion of the emulsion may be continuously taken out and fed into a decanter. In the decanter, the organic phase is separated from the aqueous phase. The aqueous phase is fed back to the cell, and the organic phase is subjected to distillation or any other suitable separating operation to obtain purified adiponitrile and to recover the unreacted acrylonitrile remaining.

During the electrolysis, acrylonitrile and water may be continuously added to the circulating emulsion, while an equivalent amount of the organic phase containing produced adiponitrile, by-products, and unreacted acrylonitrile is removed.

In the present invention, the emulsion may be treated according to a customary manner in order to more effectively suppress the evolution of hydrogen gas at the cathode. For example, a free metal blocking agent e.g. an ethylenediaminetetraacetic acid salt or triethanolamine may be added to the emulsion. The above-mentioned aqueous phase separated from the organic phase in a decanter may also be subjected to treatment with an ion exchange resin or chelate resin before being fed back to the cell. The treatment with the chelate resin is most preferred.

In the present invention, the emulsion is electrolyzed in at least one undivided cell. In the production of adiponitrile on a commercial scale, as mentioned hereinbefore, it is necessary to pass a large amount of electric current between the anode and the cathode, and generally, increasing the length of the current-passing surface is preferred to increasing the width of the surface from the viewpoint of the cost of pumps, piping and other facilities for circulating the emulsion. Increasing of the length of the current-passing surface can be attained either by employing a long electrode or connecting a plurality of cells each having, accommodated therein, an electrode of a certain length in series. In this connection, it is noted that when a current-passing surface having a large length is employed, the ratio (Vg/Vl) of the evolution rate of oxygen gas (Vg, std. liter/hr) as measured at the outlet of the cell to the flow rate of electrolyte (Vl, std. liter/hr) as measured at the inlet of the cell becomes high near the outlet of the cell.

In comparative Example 1 given later, the corrosion rate of the cathode in each of the second and third cells for which the ratio Vg/Vl is greater than 0.07 is as rapid as exhibiting a value far exceeding 1 mm/year. Also, in Comparative Example 3 given later, the corrosion rate of the cathode in each of the first and second cells for which the ratio Vg/Vl is greater than 0.05 is as rapid as exhibiting a value far exceeding 1 mm/year. The marked increase in the corrosion rate of the cathode when the ratio Vg/Vl is at least 0.05 may be attributed to a change in the flow pattern of the gas-liquid mixed flow. However, any accurate reason for this has not yet been elucidated. At any rate, when the ethyltributylammonium salt concentration is outside the range of from 0.02 to 0.08 mol/liter, the corrosion rate of the cathode in a cell for which the ratio Vg/Vl is at least 0.05 far exceeds a value of 1 mm/year.

Only from the viewpoint of the reduction of the value of a ratio Vg/Vl, the cells may be arranged in parallel in place of the arrangement in series. The arrangement of cells in parallel is effective for rendering the length of a current-passing surface small, as compared with the arrangement of cells in series. According to the decrease in the length of a current-passing surface, the ratio of Vg/Vl can be kept small, e.g. less than 0.05, thereby enabling the cathode corrosion to be retarded. However, the arrangement of cells in parallel has drawbacks, as compared with the arrangement of cells in series, in that a larger amount of electrolyte must be circulated through the cells, which leads to various disadvantages such as the need of high-cost, high-capacity manufacturing facilities, e.g. pump, gas-liquid separator, pipes and valves, the use of an increased amount of potentially dangerous materials, e.g. acrylonitrile, the difficulty in the electrolyte removal from the cells, pipes and valves, gas-liquid separator and other electrolyte circulation facilities at the time of overhaul and the difficulty in the preparation of an electrolyte having a predetermined composition at the time of start-up of adiponitrle manufacturing facilities.

In the method of the present invention, electrohydrodimerization of acrylonitrile advantageously can be conducted even at a ratio of Vg/Vl as high as 0.05 or more due to the use of an ethyltributylammonium salt in a concentration of from 0.02 to 0.08 mol/liter. Therefore, according to the method of the present invention, adiponitrile can advantageously be produced on an increased commercial scale, without the problem of rapid cathode corrosion. In other words, according to the present invention, the commercial hydrodimerization production of adiponitrile by the use of cells arranged in series, which are advantageous over the cells arranged in parallel for the reasons as mentioned above, has been realized.

As substantiated above, the method for producing adiponitrile through the electrohydrodimerization of acrylonitrile according to the present invention is remarkably improved with respect to the prevention of the corrosion of the cathode.

DETAILED DESCRIPTION OF THE PREFERRED EMBODIMENTS

This invention will now be described in detail with reference to the following Examples and Comparative Examples but they should not be construed to be limiting the scope of the present invention.

Example 1

Figure 2A:
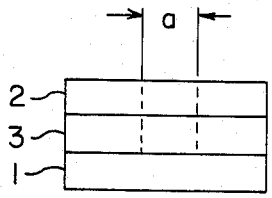
FIGS. 2 (A) and (B) are explanatory views of one form of the undivided cell to be employed in the present invention, with its cell frame taken away, in which numerals 1, 2, 3, 4 and 5 respectively denote a cathode, an anode, a spacer, an inlet for the emulsion and an outlet for the emulsion, and characters a and b respectively denote the width and length of the rectangular current-passing surface of each of the cathode and anode.
Figure 2B:
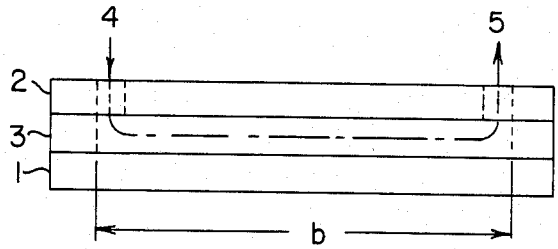
Figure 3:
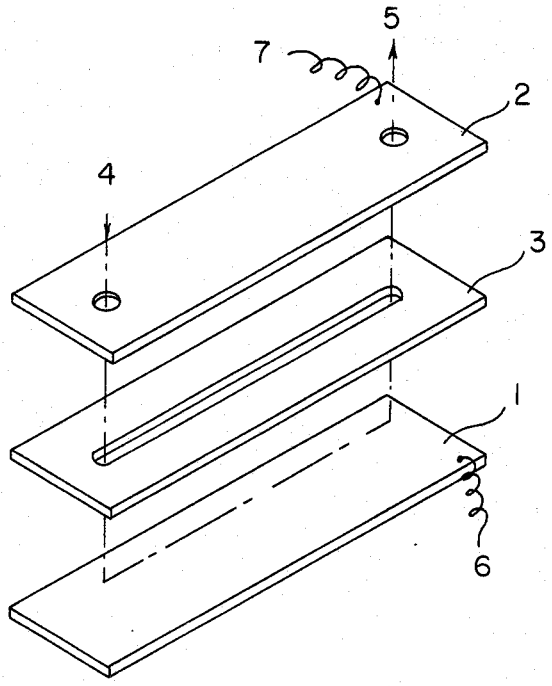
FIG. 3 is an exploded view of the undivided cell of FIGS. 2(A) and (B), in which numerals 1 to 5 are as defined above, and numerals 6 and 7 denote terminals.

Use is made of an apparatus comprising three undivided cells, as illustrated in FIGS. 2 and 3, connected in series which cells each comprised lead alloy cathode 1 having a lead content of 99% by weight or more and containing 1% or less of Cu and Te [Kimlet (trade mark) manufactured and sold by Kimura Kakoki K.K., Japan] which cathode has a rectangular current-passing surface of 1 cm in width a and 90 cm in length b, a nickel steel anode 2 having a rectangular current-passing surface of the same size and polyethylene spacer 3 of 2 mm in thickness disposed between cathode 1 and anode 2. Each of the cells has electrolyte inlet 4 and electrolyte outlet 5. The apparatus is adapted so as to enable the electrolyte kept in an electrolyte tank to be continuously circulated from the tank through the inlet of a first cell, the space between the anode and cathode of the first cell and the outlet of the same, then the inlet of a second cell, the space between the anode and cathode of the second cell and the outlet of the same, and subsequently the inlet of the remaining third cell, the space between the anode and the cathode of the cell and the outlet of the same to the electrolyte tank. The apparatus is also adapted so as to entrain the gas evolved by the electrohydrodimerization of acrylonitrile in each of the undivided cells in the electrolyte until the electrolyte is fed into the electrolyte tank, where the gas is separated from the electrolyte.

An emulsion, as an electrolyte, consisting of 80% by weight of an aqueous phase containing approximately 2% by weight of acrylonitrile, 0.04 mol/liter of ethyltributylammonium phosphate, approximately 10% by weight of potassium phosphate and approximately 3% by weight of potassium borate together with traces of adiponitrile and by-products (propionitrile and 1,3,5-tricyanohexane), the pH value of which solution is adjusted to 7.8 by addition of phosphoric acid, and 20% by weight of an organic phase consisting of approximately 28% by weight of acrylonitrile, approximately 50% by weight of adiponitrile, approximatley 5% by weight of by-products (propionitrile and 1,3,5-tricyanohexane), approximately 12% by weight of water and approximately 0.1 mol/liter of ethyltributylammonium phosphate, the concentration of each component of this organic phase being in equilibrium with that of the corresponding component of the aqueous phase, was charged into the electrolyte tank and circulated at a temperature of 55° C. and a velocity of 1.5 m/sec, in terms of the linear velocity within the space between the cathode and the anode, in the apparatus. The emulsion was electrolyzed at a current density of 20 A/dm$^2$. After initiation of the electrolysis, a portion of the emulsion was continuously transferred from the electrolyte tank to a decanter. In the decanter, the organic phase was separated from the aqueous phase. The aqueous phase was fed back through a column packed with chelate resin gels to the electrolyte tank at a velocity of approximately 8 ml/A hr. The reason for passing the aqueous phase through the column is to remove heavy metals such as Fe and Pb contained therein. During the electrolysis, acrylonitrile and water were continuously added to the circulating emulsion and an equivalent amount of the organic phase containing produced adiponitrile, by-products and unreacted acrylonitrile is removed. The organic phase is subjected to distillation to obtain purified adiponitrile and recover unreacted acrylonitrile. To compensate for the amount of ethyltributylammonium phosphate which is dissolved in the organic phase and removed due to the removal of the organic phase, ethyltributylammonium phosphate is added to maintain the ethyltributylammonium phosphate concentration of the aqueous phase of the emulsion at 0.04 mol/liter. The ratio of the evolution rate of oxygen gas (std. liter/hr, where std. means normal conditions represented by 0° C. and 1 atm. pressure) at the outlet of each cell to the flow rate of electrolyte (std. liter/hr) at the inlet of the first cell is 0.035 at the outlet of the first cell, 0.070 at the outlet of the second cell and 0.104 at the outlet of the third cell. The evolution rate of oxygen gas at the outlet of each cell is calculated according to Faraday's law from the amount of electricity passed between the anode and the cathode.

After 355 hours of the electrolysis, it is found that the adiponitrile yield relative to the consumed amount of acrylonitrile is 89.1% by volume, that the hydrogen content of the evolved gas, as measured by sampling by the use of a syringe and subjecting the sample to gas chromatography, is 0.10% by volume, and that the cathode corrosion rates, as calculated from a weight decrease of the cathode during the electrolysis, with respect to the first, second and third undivided cells are respectively 0.24, 0.31 and 0.51 mm/year.

Comparative Example 1

Substantially the same procedure as described in Example 1 is repeated, except that the ethyltributylammonium phosphate concentration of the aqueous phase of the emulsion is kept at 0.004 mol/liter.

After 212 hours of electrolysis, it is found that the adiponitrile yield relative to the consumed amount of acrylonitrile is 89.5% by volume, that the hydrogen content of the evolved gas is 0.15% by volume, and that the cathode corrosion rates, as calculated from a weight decrease of the cathode during the electrolysis, with respect to the first, second and third undivided cells are respectively 0.37, 2.36 and 2.98 mm/year.

Example 2

Substantially the same procedure as described in Example 1 is repeated, except that the ethyltributylammonium phosphate concentration of the aqueous phase of the emulsion is kept at 0.02 mol/liter, and that an apparatus comprising two undivided cells connected in series is employed in place of the apparatus comprising three undivided cells. After 155 hours of the electrolysis, it is found that the adiponitrile yield relative to the consumed amount of acrylonitrile is 88.5% by volume, that the hydrogen content of the evolved gas is 0.11% by volume, and that the cathode corrosion rates, as calculated from a weight decrease of the cathode during the electrolysis, with respect to the first and second undivided cells are respectively 0.30 and 1.07 mm/year.

Example 3

Substantially the same procedure as described in Example 2 is repeated, except that the ethyltributylammonium phosphate concentration of the aqueous phase of the emulsion was kept at 0.08 mol/liter.

After 354 hours of electrolysis, it is found that the adiponitrile yield relative to the consumed amount of acrylonitrile is 89.5% by volume, that the hydrogen content of the evolved gas is 0.11% by volume, and that the cathode corrosion rates, as calculated from a weight decrease of the cathode during the electrolysis, with respect to the first and second undivided cells are respectively 0.44 and 1.00 mm/year.

Comparative Example 2

Substantially the same procedure as described in Example 2 is repeated, except that the ethyltributylammonium phosphate concentration of the aqueous phase of the emulsion is kept at 0.10 mol/liter.

After 130 hours of electrolysis, it is found that the adiponitrile yield relative to the consumed amount of acrylonitrile was 88.4% by volume, that the hydrogen content of the evolved gas is 0.08% by volume, and that the cathode corrosion rates, as calculated from a weight decrease of the cathode during the electrolysis, with respect to the first and second undivided cells are respectively 0.41 and 2.10 mm/year.

Example 4

Substantially the same procedure as described in Example 1 is repeated, except that the electrolysis is conducted at a current density of 30 A/dm$^2$, and that an apparatus comprising two undivided cells connected in series is employed in place of the apparatus comprising three undivided cells. The ratio of the evolution volume of oxygen gas (std. liter/hr, where std. refers to 0° C. and 1 atm. pressure) to the flow rate of electrolyte (std. liter/hr) is 0.052 at the electrolyte outlet of the first cell and 0.104 at the electrolyte outlet of the second cell. After 320 hours of the electrolysis, it is found that the adiponitrile yield relative to the consumed amount of acrylonitrile is 88.5% by volume, that the hydrogen content of the evolved gas is 0.14% by volume, and that the cathode corrosion rates, as calculated from a weight decrease of the cathode during the electrolysis, with respect to the first and second undivided cells are respectively 0.41 and 0.50 mm/year.

Comparative Example 3

Substantially the same procedure as described in Example 4 is repeated, except that the ethyltributylammonium phosphate concentration of the aqueous phase of the emulsion is kept at 0.004 mol/liter.

After 278 hours of electrolysis, it is found that the adiponitrile yield relative to the consumed amount of acrylonitrile is 88.1% by volume, that the hydrogen content of the evolved gas is 0.13% by volume, and that the cathode corrosion rates, as calculated from a weight decrease of the cathode during the electrolysis, with respect to the first and second undivided cells are respectively 1.87 and 3.01 mm/year.

Comparative Example 4

Substantially the same procedure as described in Example 1 is repeated, except that the ethyltributylammonium phosphate concentration of the aqueous phase of the emulsion is kept at 0.01 mol/liter, and that an apparatus comprising a single undivided cell is employed in place of the apparatus comprising three undivided cells. After 256 hours of the electrolysis, it is found that the adiponitrile yield relative to the consumed amount of acrylonitrile is 89.0% by volume, that the hydrogen content of the evolved gas is 0.10% by volume, and that the cathode corrosion rate, as calculated from a weight decrease of the cathode during the electrolysis, in the cell is 1.55 mm/year.

Comparative Example 5

Substantially the same procedure as described in Example 2 is repeated, except that ethyltripropylammonium phosphate is employed in place of ethyltributylammonium phosphate and that their concentration in the aqueous phase of the emulsion is set at 0.05 mol/liter in place of 0.02 mol/liter. After 325 hours of electrolysis, it is found that the adiponitrile yield relative to the consumed amount of acrylonitrile is 88.6% by volume, that the hydrogen content of the evolved gas is 0.17% by volume, and that the cathode corrosion rates, as calculated from a weight decrease of the cathode during the electrolysis, with respect to the first and second undivided cells are respectively 0.42 and 1.76 mm/year.

Comparative Example 6

Substantially the same procedure as described in Example 2 is repeated, except that tetraethylammonium phosphate is employed in place of ethyltributylammonium phosphate and that their concentration in the aqueous phase of the emulsion is set as 0.04 mol/liter in place of 0.02 mol/liter. After 168 hours of electrolysis, it is found that the adiponitrile yield relative to the consumed amount of acrylonitrile was 89.0% by volume, that the hydrogen content of the evolved gas is 0.31% by volume, and that the cathode corrosion rates, as calculated from a weight decrease of the cathode during the electrolysis, with respect to the first and second undivided cells are respectively 0.29 and 2.8 mm/year.

The foregoing results are summarized in the following Table.

TABLE

| | Quarternary ammonium salt | Concentration (mol/l) | Current density (A/dm$^2$) | Vg/Vl(5) 1st cell | Vg/Vl(5) 2nd cell | Vg/Vl(5) 3rd cell | Corrosion rate of cathode (mm/year) 1st cell | Corrosion rate of cathode (mm/year) 2nd cell | Corrosion rate of cathode (mm/year) 3rd cell | Operation time (hr) | Adiponitrile yield (%) | Hydrogen content of evolved gas(4) (vol %) |
|---|---|---|---|---|---|---|---|---|---|---|---|---|
| Example 1 | EBAP(1) | 0.04 | 20 | 0.035 | 0.070 | 0.104 | 0.24 | 0.31 | 0.51 | 355 | 89.1 | 0.10 |
| Example 2 | EBAP | 0.02 | 20 | 0.035 | 0.070 | | 0.30 | 1.07 | | 155 | 88.5 | 0.11 |
| Example 3 | EBAP | 0.08 | 20 | 0.035 | 0.070 | | 0.44 | 1.00 | | 354 | 88.1 | 0.11 |
| Example 4 | EBAP | 0.04 | 30 | 0.052 | 0.104 | | 0.41 | 0.50 | | 320 | 88.5 | 0.14 |
| Comparative Example 1 | EBAP | 0.004 | 20 | 0.035 | 0.070 | 0.104 | 0.37 | 2.36 | 2.98 | 212 | 89.5 | 0.15 |
| Comparative Example 2 | EBAP | 0.10 | 20 | 0.035 | 0.070 | | 0.41 | 2.10 | | 130 | 88.4 | 0.08 |
| Comparative Example 3 | EBAP | 0.004 | 30 | 0.052 | 0.104 | | 1.87 | 3.01 | | 278 | 88.1 | 0.13 |
| Comparative Example 4 | EBAP | 0.01 | 30 | 0.052 | | | 1.55 | | | 256 | 89.0 | 0.10 |
| Comparative Example 5 | EPAP(2) | 0.05 | 20 | 0.035 | 0.070 | | 0.42 | 1.76 | | 325 | 88.6 | 0.17 |
| Comparative | TEAP(3) | 0.04 | 20 | 0.035 | 0.070 | | 0.29 | 2.80 | | 168 | 89.0 | 0.31 |

TABLE-continued

| | Quarternary ammonium salt | Concentration (mol/l) | Current density (A/dm²) | Vg/Vl(5) 1st cell | Vg/Vl(5) 2nd cell | Vg/Vl(5) 3rd cell | Corrosion rate of cathode (mm/year) 1st cell | Corrosion rate of cathode (mm/year) 2nd cell | Corrosion rate of cathode (mm/year) 3rd cell | Operation time (hr) | Adiponitrile yield (%) | Hydrogen content of evolved gas(4) (vol %) |
|---|---|---|---|---|---|---|---|---|---|---|---|---|
| Example 6 | | | | | | | | | | | | |

(1)ethyltributylammonium phosphate
(2)ethyltripropylammonium phosphate
(3)tetraethylammonium phosphate
(4)at completion of electrolysis
(5)Ratio of the evolution rate of oxygen gas (std. liter/hr) measured at the outlet of each cell to the flow rate of electrolyte (std. liter/hr) measured at the inlet of the 1st cell With respect to Examples 1 to 4 and Comparative Examples 1 to 3, the corrosion rate of the cathode in each of the cells for which the value of Vg/Vl at the outlet of the cell is greater than 0.05 is plotted against the concentration of ethyltributylammonium salt in the aqueous phase of the emulsion, thereby obtaining a graph as shown in FIG. 1. As is apparent from FIG. 1, the corrosion rate of the cathode is dependent on the concentration of ethyltributylammonium salt in the aqueous phase of the emulsion, and that the corrosion rate is advantageously low when the concentration is in the range of from 0.02 to 0.08 mol/liter.

What is claimed is:

1. In a method for producing adiponitrile which comprises electrolyzing an emulsion of an aqueous phase and an organic phase, said emulsion containing acrylonitrile and a combination of an alkali metal salt and a quaternary ammonium salt as an electrolysis supporting salt, in at least one undivided cell having a cathode of lead or a lead alloy and an anode and having an inlet and an outlet, while feeding said emulsion into said cell at its inlet and circulating said emulsion through said cell from said inlet to said outlet, thereby forming adiponitrile while evolving oxygen gas, the improvement which comprises including in said aqueous phase an ethyltributylammonium salt as the quaternary ammonium salt in a concentration of from 0.02 to 0.08 mol/-liter, and wherein said electrolysis is conducted in said undivided cell with evolution of oxygen gas at a volume ratio of at least 0.05 in terms of a ration of Vg/Vl wherein Vg represents an evolution rate of the oxygen gas (std. liter/hr) as measured at said outlet of the cell and Vl represents a flow rate of the emulsion (std. liter/hr) as measured at said inlet of the cell.

2. The method according to claim 1, wherein said electrolysis is conducted in at least two undivided cells which are connected in series, while circulating the emulsion throughout the cells.

3. The method according to claim 1, wherein the anion of said alkali metal salt is at least one member selected from the group consisting of anions from phosphoric acid, sulfuric acid and boric acid.

4. The method according to claim 1, wherein a portion of said emulsion is continuously taken out and fed into a decanter where the organic phase is separated from the aqueous phase.

5. The method according to claim 1, wherein acrylonitile and water is continuously added to the circulating emulsion, while an equivalent amount of the organic phase containing produced adiponitrile, by-products, and unreacted acrylonitrile is removed.

6. The method according to claim 4, wherein the aqueous phase separated from the organic phase is subjected to treatment with an ion exchange resin or chelate resin and then fed back to the cell.

* * * * *